US005141336A

United States Patent [19]

Sander

[11] Patent Number: 5,141,336

[45] Date of Patent: Aug. 25, 1992

[54] CARRYING BAG

[75] Inventor: Volkhard Sander, Lengerich, Fed. Rep. of Germany

[73] Assignee: Windmoller & Holscher, Lengerich, Fed. Rep. of Germany

[21] Appl. No.: 693,246

[22] Filed: Apr. 29, 1991

[30] Foreign Application Priority Data

May 14, 1990 [DE] Fed. Rep. of Germany ..... 4015456

[51] Int. Cl.[5] ..... B65D 33/10; B65D 33/24

[52] U.S. Cl. ..... 383/27; 383/86

[58] Field of Search ..... 383/6, 27, 86

[56] References Cited

U.S. PATENT DOCUMENTS

| | | | |
|---|---|---|---|
| 1,065,450 | 6/1913 | Klein | 383/86 |
| 3,493,166 | 2/1970 | Smith et al. | 383/86 |
| 3,688,974 | 9/1972 | Gennerich et al. | 383/86 |
| 3,693,867 | 9/1972 | Schwarzkopf | 383/86 |
| 3,722,785 | 3/1973 | Rivman | 383/27 |
| 4,493,110 | 1/1985 | Wilson | 383/27 |

FOREIGN PATENT DOCUMENTS

| | | |
|---|---|---|
| 3400499 | 7/1985 | Fed. Rep. of Germany . |
| 2129623 | 10/1972 | France . |
| 2403761 | 4/1979 | France . |
| 597784 | 4/1978 | Switzerland . |

*Primary Examiner*—Stephen P. Garbe

*Attorney, Agent, or Firm*—Fleit, Jacobson, Cohn, Price, Holman & Stern

[57] ABSTRACT

A carrying bag of thermoplastic material has side walls with inwardly folded top edge portions to which handle loops made of a similarly flexible material are bonded. In order to obtain a multifunctional bag which can be easily and economically manufactured and readily recycled, the edge portion of one side wall protrudes beyond the edge portion of the other side wall, the protruding edge portion having a slit-like cut so that the protruding edge portion can be folded over the opposite side of the bag.

4 Claims, 3 Drawing Sheets

CARRYING BAG

BACKGROUND OF THE INVENTION

1. Field of the Invention

This invention relates to a carrying bag of thermoplastic material, which comprises side walls with inwardly folded top edge portions to which handle loops of a similarly flexible material are bonded.

2. Description of Prior Art

Carrying bags of the above kind are commonly used as shopping bags but because they are open towards the top, goods transported therein are not completely protected against rain and the like.

On the other hand textile carrying bags made of thermoplastic material are also known, in which the textile goods transported therein are protected from the elements by a flap. Textile carrying bags of this kind are usually provided with handle portions of a relatively flexurally stiff synthetic material and are welded to the top edge portions of the carrying bags through corresponding reinforcing webs. These bags have certain disadvantages with regard to their manufacture and recycling. In the first place, different machines for processing synthetic material are required to make the bags, since the bag and the handles consist of different synthetic materials, respectively. For recycling, the strong handles made by injection molding must be separated from the body of the bag by expensive manual work before the handles can be regranulated separately from the thermoplastic material.

SUMMARY OF THE INVENTION

It is an object of the present invention to provide carrying bags made of thermoplastic material which serve multifunctional purposes, i.e., which can be used as a carrying bag for foodstuffs or the like and also as textile-carrying bag for goods to be protected from rain. In this respect, on the one hand, the bag should be simple and therefore economical to manufacture and, on the other hand, be easy to recycle.

Therefore in a carrying bag according to the invention, the edge portion of one side wall protrudes beyond the edge portion of the other side wall. The protruding edge portion has a slit-like cut in the region of the handle loops. Thereby, the protruding edge portion can be used in a very simple manner as a closing flap for protecting the bag contents from rain and the like when using the bag as a textile-carrying bag. If, on the other hand, the carrying bag is to be used as a common carrying bag for goods not to be protected, the edge portion can be folded outwardly over the side wall. No extra closing flap needs to be especially provided on the carrying bag, which in particular leads to a simplification of the manufacturing procedure.

The inwardly reversely folded edge portion of the carrying bag can be bonded with the respective corresponding side wall along their border edge open to the inside. Thus, the edge portions are not only bonded, i.e. welded or glued at the lateral border edges of the side wall. Thereby, in particular, not only is the stability of the edge portions of the carrying bag increased in an advantageous manner, but also unintentional tearing is made more difficult.

Within the protruding edge portion a weld seam or gluing line is arranged substantially in parallel to the backward fold and extending between the backward fold and the slit in an advantageous manner. Thereby, in the region of the slit in the protruding edge portion an unintentional pulling apart of the edge portion when putting the handle loop in the slit is advantageously avoided. Furthermore, the protruding edge portion is additionally reinforced thereby. The handle loops can be continuously welded at their ends to the edge portions, i.e. the welding point, covering a corresponding area, forms a bond of the respective handle loop end with the two superimposed foil portions of the corresponding edge portion. Said penetration welding additionally fixes the superimposed foils of the edge portions and thereby simultaneously increases the stability of the carrying bag.

Embodiments of the invention will now be described in the following with reference to the drawings.

DETAILED DESCRIPTION OF PREFERRED EMBODIMENTS

Figure 1:
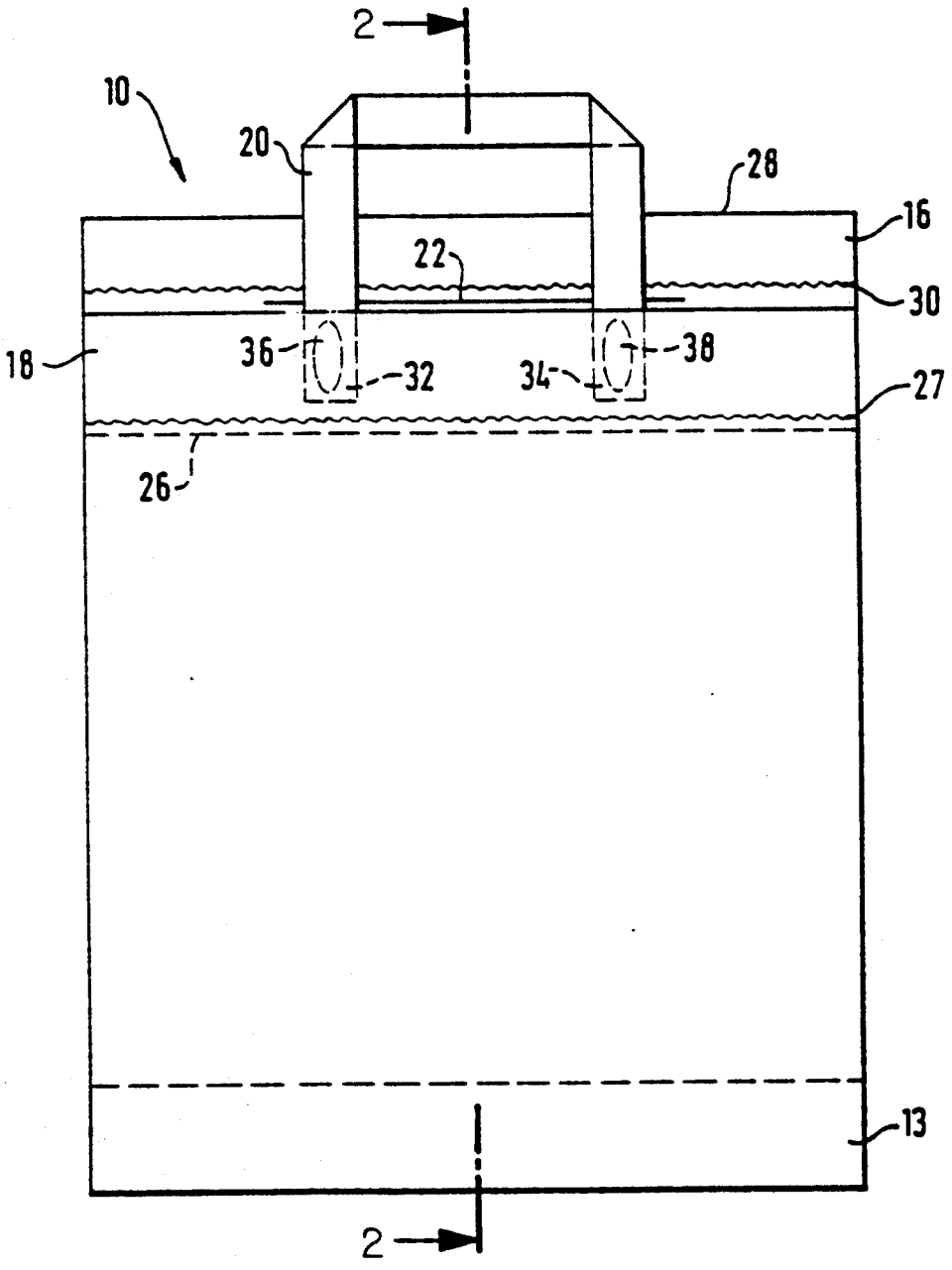
FIG. 1 is a diagrammatic elevational view of a carrying bag according to the invention.
Figure 2:
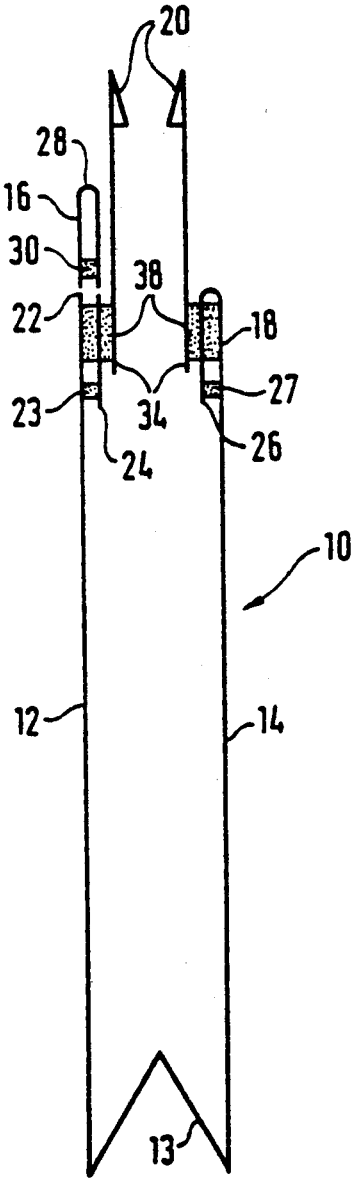
FIG. 2 is a sectional view on line A—A of FIG. 1.

The carrying bag of thermoplastic material 10 as shown in FIG. 1 comprises two side walls 12, 14 and a bottom fold 13. The side walls 12, 14 are laterally welded to each other. At the open side opposite to the bottom bold 13, the side walls 12, 14 are inwardly reversely folded, thereby forming edge portions 16, 18, the border edges 24, 26 being open to the inside and coming to lie approximately on the same level. One edge portion 16 protrudes above the other edge portion 18, as represented in FIGS. 1 and 2.

Along their border edges 24 or 26, open to the inside a closing weld seam 23 or 27 is drawn along the edge portions 16 or 18. Thus, the edge portions 16 and 18 are laterally sealed by the weld seams of the side walls and towards the bottom bold 13 by the weld seams 23 and 27. The handle loops 20 also consisting of a thermoplastic material are welded to the edge portions 26 or 18 at the ends 32 and 34 of the handle loops through the medium of spot weld seams 36 and 38. The welding connects the respective handle ends with two superimposed foils forming the respective edge portions 16, 18. The protruding edge portion 16 has a slit 22 in the region of the handle loops 20. The handle loops 20 can be passed through said slit 22, if the protruding edge portion 16 is to be used as a flap to protect the bag contents from rain etc.

Between the slit 22 and the backward fold 28 of the protruding edge portion 16, and adjacent the slit, an additional weld seam 30 is provided which preferably extends along the entire length of the edge portions 16 substantially in parallel to the backward fold 28. This weld seam prevents in an advantageous manner an unintentional pulling apart of the two superimposed foils of synthetic material of the edge portion 16, if the handle loops 20 are passed through the slit.

Figure 3:
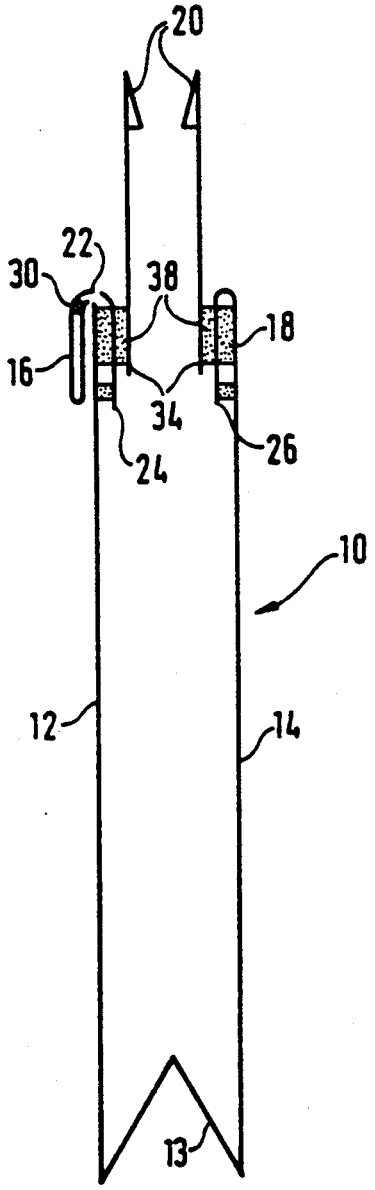
FIG. 3 is a sectional view substantially corresponding to FIG. 2, but showing the carrying bag in a state ready for use.

FIG. 3 shows the carrying bag in one of its states of use. In the state of use represented therein, the carrying bag is used as carrying bag for goods not to be especially protected, the protruding edge portion 16 being folded outwardly onto the side wall 12. In this state of use, the goods transported in the carrying bag 10 are not protected from rain etc. The carrying bag as shown in FIG. 3 can easily be converted into a textile-carrying bag in that, after putting the goods into the carrying bag 10, the flap 16 is folded over the opposite side wall 14 after passing the handle loops 20 through the slit 22, thereby protecting the textile goods transported in the carrying bag from rain etc.

I claim:

1. A carrying bag of thermoplastic material, which comprises side walls with inwardly folded top edge portions to which handle loops made of a flexible material are bonded, wherein the edge portion of one side wall protrudes beyond the edge portion of the other side wall, and the protruding edge portion has a slit-like cut opposite the handle loops for the loops to pass through so that the protruding edge portion can be folded over the outside of said other side wall.

2. A carrying bag according to claim 1, wherein the inwardly folded edge portions are bonded with the respective side walls along their respective edges.

3. A carrying bag according to claim 1, wherein within the protruding edge portion one of a weld seam and a gluing line is provided substantially in parallel to a backward fold defining the edge portion, said one of a weld seam and a gluing line extending between the backward fold and the cut.

4. A carrying bag according to claim 1, wherein each end of the handle loops is welded to the respective inwardly folded edge portions.

* * * * *